US006011359A

United States Patent [19]

Days

[11] Patent Number: 6,011,359

[45] Date of Patent: Jan. 4, 2000

[54] MULTIPLE FLASH/SINGLE LAMP CIRCUIT FOR FAST SEQUENTIAL STROBING

[75] Inventor: Charles A. Days, Dartmouth, Mass.

[73] Assignee: Acushnet Company, Fairhaven, Mass.

[21] Appl. No.: 09/008,588

[22] Filed: Jan. 16, 1998

[51] Int. Cl.[7] ..... H05B 37/00

[52] U.S. Cl. ..... 315/241 S; 315/241 P; 315/241 R; 315/287; 315/323

[58] Field of Search ..... 315/241 S, 241 P, 315/241 R, 200 A, 323, 231, 176, 287

[56] References Cited

U.S. PATENT DOCUMENTS

| | | | |
|---|---|---|---|
| 3,930,184 | 12/1975 | Biber et al. | 315/241 P |
| 3,973,168 | 8/1976 | Kearsley | 315/232 |
| 4,139,805 | 2/1979 | Cosco et al. | 315/241 R |
| 4,185,232 | 1/1980 | Ingalls et al. | 315/241 R |
| 4,742,277 | 5/1988 | Shibuya et al. | 315/176 |
| 4,900,990 | 2/1990 | Sikora | 315/241 P |
| 5,051,665 | 9/1991 | Garrison et al. | 315/287 |
| 5,196,766 | 3/1993 | Beggs | 315/241 R |
| 5,347,200 | 9/1994 | De Nardis | 315/241 S |

OTHER PUBLICATIONS

Alex D. McLeod, "Design Considerations for Triggering of Flashlamps", Nov. 1996.

"Linear Flashlamps Technical Brief, E6&G electro Optics", 1995.

Charles A. Holt, "Electronics Circuits; Digital and Analog", 1978.

Jacob Millman, "Micro–Electronics; Digital and Analog Circuits and Systems", 1979.

Irving Gottlieb, "Power Supplies, Switching Regulators, Inverters & Converters", 1976.

Paul R. Gray and Robert G. Meyer, "Analysis and Design of Analog Integrated Circuits", 1984.

William H. Hayt and Jack E. Kemmerly, "Engineering Circuit Analysis", 1979.

*Primary Examiner*—Haissa Philogene

*Attorney, Agent, or Firm*—Penny & Edmonds LLP

[57] ABSTRACT

The present invention discloses a multiple flash/single lamp circuit for fast sequential strobing. More particularly, the present invention comprises a flashlamp, a pair of capacitors, a voltage multiplier and regulator to charge the capacitors, a pair of trigger circuits to discharge the capacitors and a controller to selectively activate each trigger circuit to activate the flashlamp.

16 Claims, 8 Drawing Sheets

MULTIPLE FLASH/SINGLE LAMP CIRCUIT FOR FAST SEQUENTIAL STROBING

FIELD OF THE INVENTION

The present invention relates generally to a multiple flash/single lamp circuit for fast sequential strobing. More particularly, the present invention comprises a flashlamp, a pair of capacitors, a voltage multiplier and regulator to charge the capacitors, a pair of trigger circuits to discharge the capacitors and a controller to selectively activate each trigger circuit to activate the flashlamp.

BACKGROUND

Flashlamps are used in many different applications including photocopiers, lasers, analytical and clinical instruments, machine vision strobes, aviation obstruction warning beacons medical devices and instruments to monitor the launch characteristics of objects including golf balls. A flashlamp is an arc lamp that operates in the pulsed mode and is capable of converting stored electrical energy into intense bursts of radiant energy covering the ultraviolet (UV), visible (VIS), and infrared (IR) regions of the spectrum. Flashlamps are similar to all other arc lamps in that optical radiation is produced by passing an electrical current through a gas. Both continuous and line spectra are produced when sufficient energy is transferred to the gas atoms to cause excitation and ionization. See "Transport Phenomena in a Completely Ionized Gas", Spitzer, L., Jr., and R. Harm, Phys. Rev., 89, 977–981. (Spitzer).

Xenon is used in most flashlamps, since it is the most efficient of the inert gases at converting electrical energy to optical energy. Krypton is sometimes used because of its high efficiency in the near-infrared region. Current is usually supplied by a charged capacitor capable of discharging large amounts of energy in a short period of time. Depending on the value of the capacitor and other circuit components, pulse widths from under 1 microsecond to over 50 milliseconds and energies from millijoules to kilojoules can be produced.

This characteristic of producing energy in pulses of extremely high peak values and very short duration is a great advantage in many applications because it means that while peak optical power is typically in the kilowatt-to-megawatt region, the average power, which determines the size and cost of the power supply is in the watts-to-hundreds-of watts region. A further advantage of flashlamps is that even though the output spectrum is broadband, specific regions of the spectrum can be emphasized by controlling current through the flashlamp. For instance, at relatively low values of lamp current the spectral output is heavily weighted toward the visible and infrared end of the spectrum. As current is increased, the output shifts toward the blue and ultraviolet. See Design Considerations for Triggering of Flashlamps, Alex D. McLeod, EG & G Electro-Optics, Salem, Mass. November 1996 ("McLeod").

FIG. 1 provides an illustration of a flashlamp circuit comprising a power supply, a capacitor 1 and a flashlamp 2. In the nonionized state, a flashlamp has high impedance (tens of megohms). Therefore, all current from the power supply initially flows into the capacitor 1 as shown by the circuit of FIG. 1. As the voltage across the capacitor 1 is increased, a point is reached, called the breakdown voltage, where xenon atoms are ionized and the impedance of the flashlamp 2 starts to drop. In a short period of time, enough xenon atoms are ionized so that a low-impedance path is formed from anode to cathode, and current flows from the capacitor 1 through the flashlamp 2. As this occurs, more xenon atoms are ionized and the arc impedance continues to drop to the milliohm region. The arc also expands outward to eventually fill the bore of the flashlamp. Most of the energy stored in the capacitor 1 is expended in a matter of microseconds so that, eventually, the current through the flashlamp 2 drops to such a low level that the tube deionizes and stops conducting. At this point, the capacitor 1 starts recharging. See Linear Flashlamps Technical Brief, E6&G Electro Optics Salem, Mass., 1995. (Linear Flashlamps).

Although the circuit in FIG. 1 is a useful illustration of how a flashlamp works, it is not a practical circuit. The breakdown voltage of most xenon flashtubes is high, typically 10 kV or more, and is not very repeatable. Therefore, most practical flashlamp circuits utilize a capacitor charging voltage which is much lower than the breakdown voltage. Conduction is then initiated by application of a brief high-voltage trigger pulse. Previous approaches have used different types of triggering to activate the flashlamp including: external, series, pseudo series, simmer, and pseudo simmer. See McLeod, pg. 2–8.

FIG. 2 provides an illustration of an external trigger comprising a capacitor charging power supply, capacitors 4, 8, an inductor 5, a flashlamp 6, a transformer 7 a resistor 10 and a silicon controlled rectifier (SCR) 9 having a trigger pulse input 11, external triggering creates a small arc streamer between the electrodes by applying a high voltage trigger pulse to a thin wire wrapped around the outside of the flashlamp 6. The pulse can also be applied to a metal bar, reflector, or cavity as long as the metal covers the entire distance between the electrodes. In these latter cases, the spacing between the lamp and metal piece should be no more than ¼-inch and somewhat higher trigger voltages may be needed. The trigger pulse 11 is supplied by a high-turns ratio transformer 7 which can be compact and lightweight, since it has to produce high voltage but little current (100–300 mA). A finite amount of time is required for the trigger streamer to propagate down the bore of the flashlamp. The pulse duration for external triggering should be about 200 nanoseconds per inch of arc length. Required trigger voltages depend on arc length, bore size, fill pressure, and electrode material and are typically listed in flashlamp specification sheets. See McLeod, pg. 2–3.

In the series technique, the trigger voltage is applied directly to one of the flashlamp electrodes from the secondary of a transformer which is placed in series with the flashlamp. Again, the purpose is to create a small arc streamer between the electrodes. Although it is not required, the trigger wire, used for external triggering, may be left wrapped around the lamp and grounded. This facilitates triggering by lowering the voltage requirement. The series trigger transformer is larger and heavier than the parallel transformer since the secondary must carry the full flashlamp current. Also, the secondary adds impedance to the circuit, and this must be considered in the circuit design. In fact, by choosing a trigger transformer having the proper value of saturated inductance, no other choke should be necessary to achieve critical damping. The trigger pulse duration for a series trigger is 150 nanoseconds per inch of are length, and the required voltages are typically listed in flashlamp specification sheets. See McLeod, pg 4–6.

In the pseudo-series technique as in the series technique, the trigger voltage is applied directly to one of the flashlamp electrodes. However, in this circuit an external trigger transformer is used but the capacitor discharge does not pass through the transformer secondary. Blocking diodes prohibit the trigger voltage from appearing across the discharge capacitor. The blocking diodes must be selected with care as they not only hold off the high voltage trigger pulse but must be capable of carrying the discharge current as well. Should critical damping be required, an inductor of appropriate value must be added in the discharge loop. See McLeod, pg 6–7.

The simmer mode technique utilizes a separate power supply to maintain a continuous DC current through the flashlamp and keep it in the ionized state. Typical simmer currents are 100 milliamps up to several amps. Flashlamp pulsing is accomplished by closing a switch, typically a silicon controlled rectifier (SCR), in series with the capacitor and flashlamp. An external or series trigger circuit is also required to initially start the flashlamp. In the pseudo-simmer circuit, the simmer current is turned on just before the main discharge so the flashlamp is pre-ionized. See McLeod, pg 7–8.

U.S. Pat. No. 4,742,277 discloses a pulse generating apparatus including a base current supply section for generating a constant dc current having a first prescribed current level for turning on a xenon lamp, and a pulse current section for adding a pulse current having a second current level greater than the first current level and a prescribed pulse duration within a prescribed repetition period to the constant dc current.

U.S. Pat. No. 5,196,766 discloses a discharge circuit and a method of operating a flashlamp wherein the flashlamp is reliably operated repetitively while reducing current surges from the electrical power source. The circuit provides a switch means for shunting recharge energy through a non-reactive means around an energy storage means for the flashlamp. The rate of recharging the energy storage means is reduced at the beginning of recharging below the rate which would allow the flashlamp to conduct before intentional triggering of a flash.

The activation of flashlamps must consider peak current and recharge time. It is important to know the peak current through a flashlamp for several reasons. First, the spectral output is a function of the current density through the flashlamp. As the current density is increased from a few tens of $A/cm^2$ (cross-sectional area) to a few thousand $A/cm^2$, the intensity in the blue and ultraviolet increases far more rapidly than the red and infrared. Color temperature at the low currents is about 5000° Kelvin and at the high currents about 10,000° Kelvin. In addition, the line structure, which is strong in the infrared at low current densities, becomes almost completely masked at high current densities. At current densities under 4000 $A/cm^2$, both xenon and krypton have a particularly good match with the absorption curve of neodymium-YAG laser material. Further, there are limitations on peak current which, if surpassed, result in damage to the lamp and early failure. See Linear Flashlamp pg. 5–6.

The maximum flashing frequency is determined by the deionization time of the flashlamp and the charging rate of the capacitor. If the charging current rises too quickly after the lamp has flashed, it will go into a holdover condition. In the holdover state, the flashlamp never deionizes. Instead, the charging current bypasses the capacitor and flows through the lamp in a continuous DC arc. Holdover can permanently damage a lamp in a very short time because of overheating of the electrodes. Holdover actually occurs when the capacitor voltage rises to the minimum tube operating voltage before deionization occurs. See Linear Flashlamps, pg. 8.

While previous research has disclosed different methods for activating a flashlamp, there remains a need for a system which achieves fast sequential strobing with a single lamp while limiting the charging current to prevent holdover and while limiting the peak current to the flashlamp to extend the life of the lamp and to weigh the spectral output heavily toward the visible and infrared end of the spectrum.

SUMMARY OF THE INVENTION

In general, it is an object of the present invention to provide an electrical circuit for rapid selective strobing of a flashlamp by including at least two capacitors in the electrical circuit to enable repeated activation of the flashlamp without waiting for charge to accumulate on the capacitors.

It is an object of the present invention to achieve this general objective by providing an electrical circuit for selectively strobing a flashlamp comprising a flashlamp; at least two capacitors for holding charge; a power source for providing charge to the capacitors; a discharge circuit; at least two trigger circuits wherein each of the trigger circuits discharges a corresponding one of the capacitors across the flashlamp through the discharge circuit for activating the flashlamp wherein at least one of the capacitors holds charge after another of the capacitors has discharged for rapid strobing of the flashlamp; and an external controller for activating the trigger circuits with a trigger pulse to activate the flashlamp.

It is a further object of the present invention to achieve this general objective by providing an electrical circuit for selectively strobing a flashlamp wherein each of the trigger circuits comprises: a silicon controlled rectifier having a gate, an anode, and a cathode, for selectively providing a discharge path from the corresponding one of the capacitors to the flashlamp; a field effect transistor having a source and a drain wherein the drain is connected to a source capacitor and the source is connected to a source resistor, the field effect transistor selectively providing a voltage from the source capacitor to the gate of the silicon controlled rectifier; and an optoisolator having an optically connected light emitting diode and a phototransistor, the phototransistor having an emitter resistor, for selectively providing a voltage to the gate of the field effect transistor upon receiving a trigger pulse from the external controller.

It is a further object of the present invention to achieve this general objective by providing an electrical circuit for selectively strobing a flashlamp wherein the discharge circuit comprises: a transformer having a primary coil and a secondary coil connected in parallel with the flashlamp, the primary coil selectively connected to the capacitors for amplifying the trigger pulse from the external controller across said secondary coil; a plurality of Zener diodes connected to the primary coil for limiting an amplitude of the trigger pulse across the secondary coil to limit a current through the flashlamp to a predetermined level; a primary coil capacitor connected to the primary coil for producing the trigger pulse across the primary coil; a plurality of blocking diodes connected to the flashlamp and to the secondary coil for providing a discharge path from the capacitors to the flashlamp and for prohibiting the trigger voltage from appearing across the capacitors; and a shunt diode connected to the capacitors and connected to the plurality of blocking diodes for preventing a negative current swing through said flashlamp.

It is another general object of the present invention to provide a method for rapid selective strobing of a flashlamp with an electrical circuit comprising at least two capacitors to enable repeated activation of the flashlamp without waiting for charge to accumulate on the capacitors.

BRIEF DESCRIPTION OF THE DRAWINGS

FIG. 6 displays a model of a prior art silicon controlled rectifier used in the circuit in accordance with the present invention.

DETAILED DESCRIPTION OF THE PREFERRED EMBODIMENT

Figure 1:
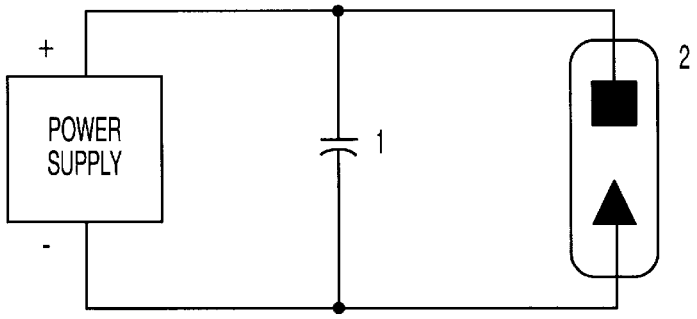
FIG. 1 PRIOR ART
FIG. 1 provides a schematic of a basic prior art flashlamp circuit.
Figure 2:
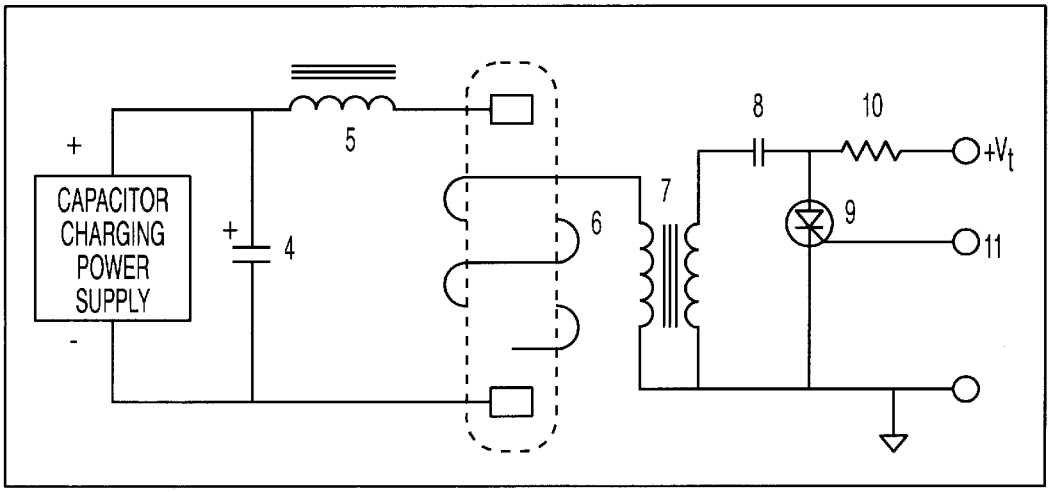
FIG. 2 PRIOR ART
FIG. 2 provides a schematic of a prior art flashlamp circuit using an external trigger.
Figure 3:
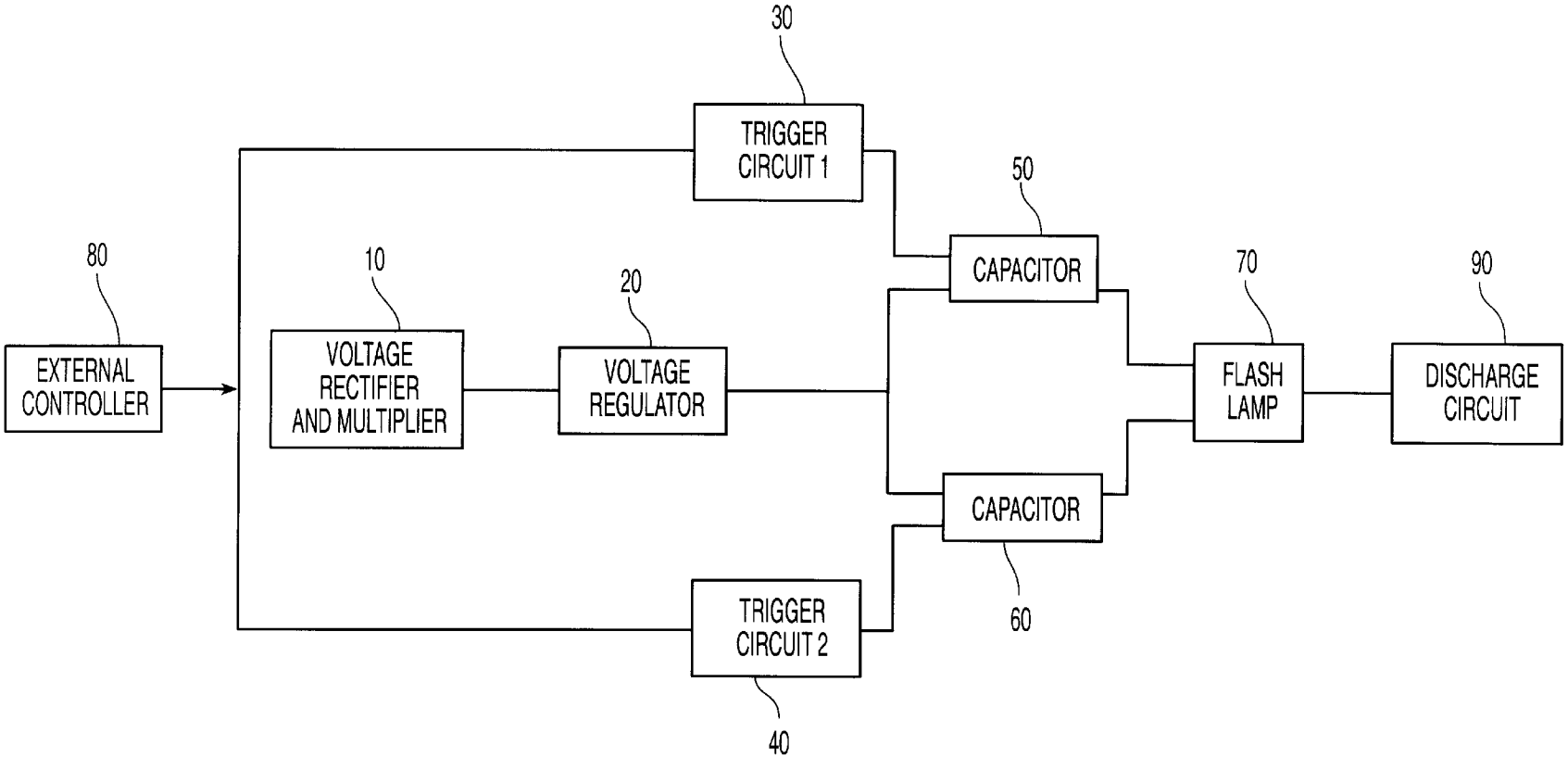
FIG. 3 provides a block diagram of the present invention.

FIG. 3 provides a block diagram of the present invention. The present invention comprises a voltage rectifier and multiplier 10, a voltage regulator 20, a first trigger circuit 30, a second trigger circuit 40, a first capacitor 50, a second capacitor 60, a flashlamp 70, an external controller 80 and a flashlamp discharge circuit 90.

The voltage rectifier and multiplier 10 and the voltage regulator 20 provide the regulated power supply required by the circuit. In spite of large variations which may occur in the line voltage, the load current, and the temperature, the voltage regulator 20 maintains the output dc voltage near the desired value.

The voltage rectifier and multiplier 10 converts the ac input into a pulsating waveform with both dc and ac components. The output voltage of the voltage rectifier and multiplier 10 has a nonzero average value $V_{dc}$. Harmonics of the frequency are present in the output voltage. With an input at 60 Hz, the frequencies in the output voltage are 0, 60, 120, 180, etc. The ripple factor r, defined as $V_{ac}/V_{dc}$, where $V_{ac}$ denotes the rms value of the alternating components of $V_L$ not including $V_{dc}$, is a criterion for specifying the amount of ac present in the output of a power supply. Accordingly, the voltage rectifier and multiplier 10 also smooths the ac ripple in the output voltage with a filter circuit. See Electronic Circuits: Digital and Analog, Charles A. Holt, John Wiley & Sons, Inc. 1978 (Holt), Chapter 24.

The voltage rectifier and multiplier 10 operates by alternatively charging an arrangement of capacitors to the peak input voltage $V_m$, current being continually drained from the capacitors through the load. The capacitors also act to effect filtering. The action of the circuit depends upon the fact that the capacitor stores energy during the conduction period and delivers the energy to the load during the inverse, or nonconducting, period. In this way, the time during which the current passes through the load is prolonged, and the ripple is considerably decreased where the ripple is defined as the deviation of the load voltage from its average or dc value. See Micro-Electronics: Digital and Analog Circuits and Systems, Jacob Millman, McGraw-Hill Book Company, 1979, (Millman), Chapter 10.

Line voltages at the input of the power supply could fluctuate by as much as 10 to 20% to cause the output voltage of the voltage rectifier and multiplier 10 to vary. Current drawn by the power-supply load may also have a wide range of values. In addition, the temperature may change. The current and temperature changes tend to change the output voltage. Accordingly, the voltage regulator 20 is connected between the voltage rectifier and multiplier 10 and the load to maintain a nearly constant output voltage for anticipated variations in the input voltage, the load current, and the temperature. See Holt, Chapter 24.

An important figure of merit is the voltage regulation which is defined as the percentage change in the output voltage resulting from a specified change in either the input voltage or the load current. With the input held constant, and the load current changed from a minimum to a maximum value, the voltage regulation performed by the voltage regulator 20 is called load regulation. See Holt, Chapter 24.

The present invention utilizes dual capacitors 50, 60 to achieve fast sequential strobing with a single flashlamp. The present invention also utilizes an external controller 80 with a flashlamp discharge circuit 90 to accurately trigger the flashlamp to prevent holdover and to limit the peak current to the flashlamp 70 to extend the life of the flashlamp 70 and to weigh the spectral output heavily toward the visible and infrared end of the spectrum.

The voltage rectifier and multiplier 10 and the voltage regulator 20 provide a regulated power supply to charge the first capacitor 50 and the second capacitor 60. After the first capacitor 50 has discharged to activate the flashlamp 70, the circuit of the present invention does not need to wait for the first capacitor 50 to charge before activating the flashlamp 70 a second time because the charge required to activate the flashlamp 70 a second time is available on the second capacitor 60 after the discharge of the first capacitor 50.

The external controller 80 selectively activates the first trigger circuit 30 and the second trigger circuit 40 to activate the flashlamp 70 at particular instances in time. Without activation from the external controller 80, the first trigger circuit 30 and the second trigger circuit 40 act to prevent the flow of current from the first capacitor 50 and the second capacitor 60 respectively to the flashlamp 70.

When the external controller 80 activates the first trigger circuit 30, the first trigger circuit 30 provides a path for the first capacitor 50 to discharge across the flashlamp 70. As the voltage across the anode and the cathode of the flashlamp 70 is increased, a point is reached, called the breakdown voltage, where the xenon atoms of the flashlamp 70 are ionized and the impedance of the flashlamp 70 starts to drop. In a short period of time, enough xenon atoms are ionized so that a low-impedance path is formed from the anode to the cathode of the flashlamp 70. As this occurs, more xenon atoms are ionized and the arc expands outward as the arc impedance drops to the milliohm region to eventually fill the bore of the flashlamp. Most of the energy stored in the first capacitor 50 is expended in a matter of microseconds so that, eventually, the current through the flashlamp 70 drops to such a low level that the tube deionizes and stops conducting. The external controller 80 operates to activate the second trigger circuit 40 to discharge the second capacitor 60 across the flashlamp 70 in the same fashion.

The external controller 80, the dual capacitors 50, 60, and the dual triggers 30, 40 enable precise activation of the flashlamp 70 at particular instances in time at the visible and infrared regions of the spectrum while extending the life of the flashlamp 70. The precise activation of the flashlamp 70 prevents the flashlamp 70 from exceeding the maximum flashing frequency and going into a holdover condition. In the holdover state, the flashlamp 70 never deionizes and current flows through the lamp in a continuous dc arc. Holdover can permanently damage the flashlamp 70 in a very short time because of overheating of the electrodes. The external controller 80 prevents holdover by ensuring a minimum amount of time passes before successive activations of the flashlamp 70.

The dual capacitors 50, 60 and the dual trigger circuits 30, 40 provide flashes at the visible and infrared region of the spectrum and extend the life of the flashlamp 70 because they activate the flashlamp 70 with a low current density. The spectral output of the flashlamp 70 is a function of the current density through the flashlamp. As the current density is increased from a few tens of $A/cm^2$ to a few thousand $A/cm^2$, the intensity in the blue and ultraviolet increases far more rapidly than the red and infrared. See Linear Flashlamps, pg. 5–6. Next, the flashlamp 70 has limitations on the peak current which, if surpassed, result in damage to the lamp and early failure. Accordingly, the lower current density associated with the capacitors 50, 60 and the flashlamp discharge circuit 90 of the present invention provide flashes at the visible and infrared region of the spectrum and avoid damage to the flashlamp 70. Finally, the dual capacitor 50, 60 and dual trigger circuits 30, 40 arrangement of the present invention enable the capacitors 50, 60 to charge at lower currents to decrease the cost of the power supply.

The flashlamp discharge circuit 90 operates to interrupt the current from the capacitors 50, 60 to the flashlamp 70 after activation of the flashlamp to prevent holdover. The flashlamp discharge circuit 90 also operates to eliminate a negative current swing through the flashlamp 70 to avoid a ringing condition associated with an underdamped discharge circuit. See Linear Flashlamps, pg. 8.

Figure 4A:
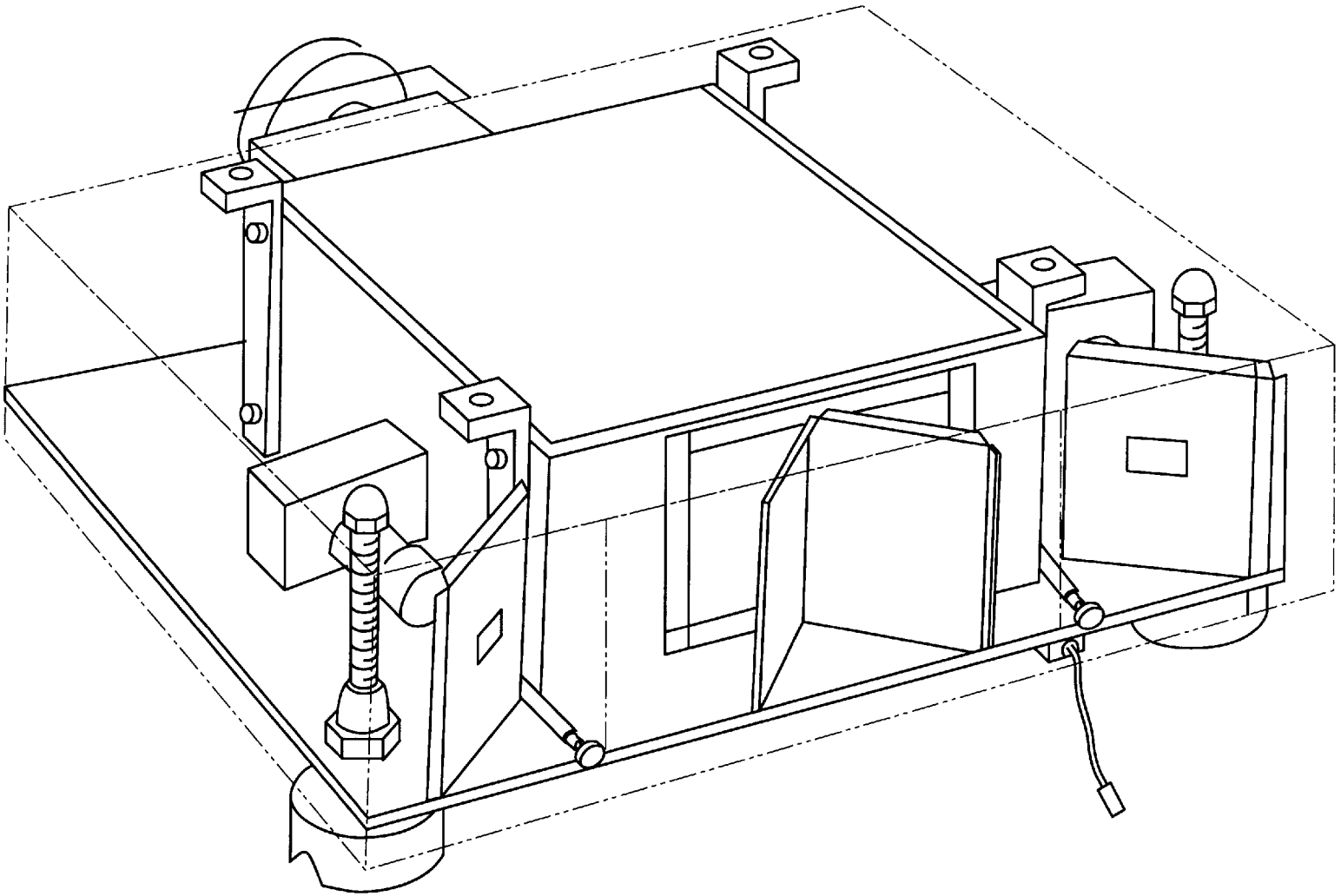
FIG. 4A provides a perspective view of a launch monitor which uses the flashlamp circuit of the present inventor.
Figure 4B:
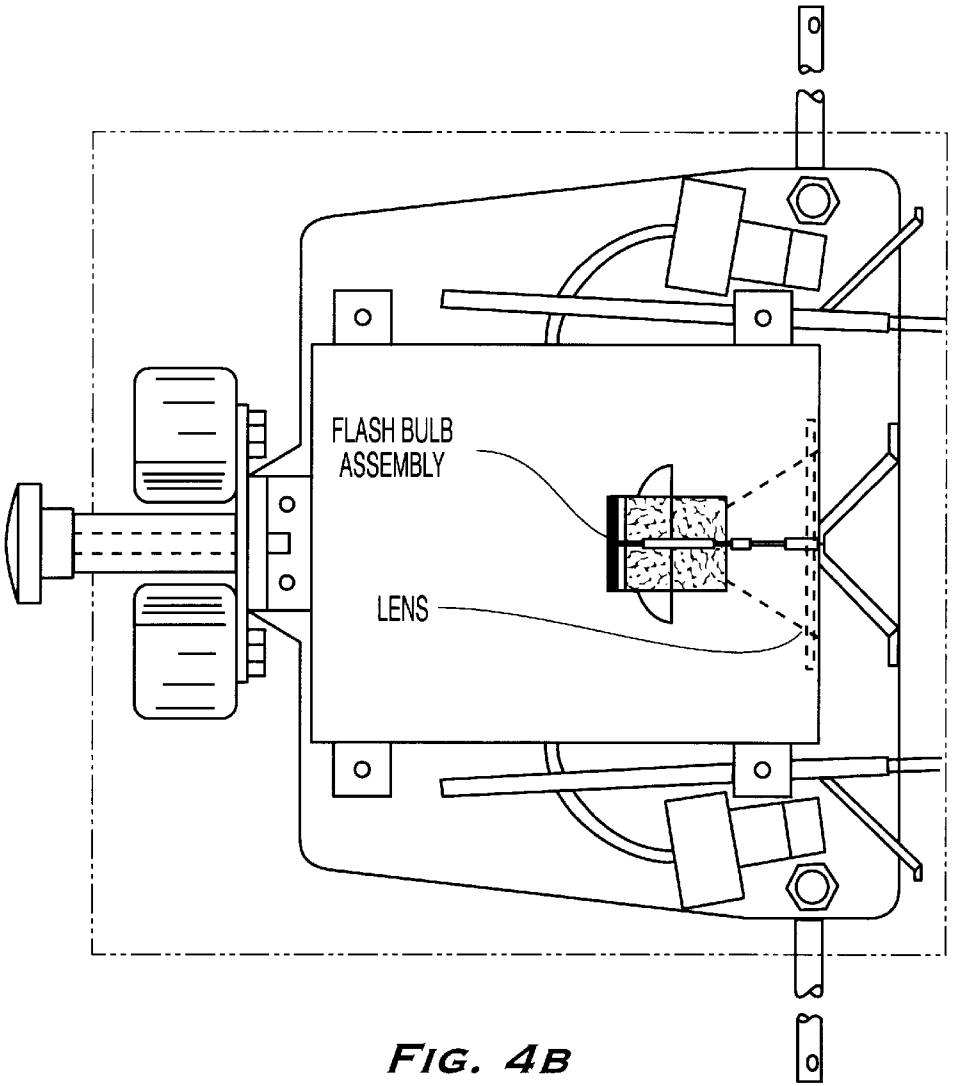
FIG. 4B provides a top view of a launch monitor which uses the flashlamp circuit of the present invention.

The present invention is particularly adapted for use in instruments which measure the movement of objects and object striking devices including golf balls and golf club heads. FIGS. 4A and 4B provide a perspective view and a top view respectively of an exemplary instrument which monitors the launch characteristics of a golf ball and the movement of a golf club head. The instruments to measure the movement of objects and object striking devices are the subject of other commonly assigned patent applications and patents which are herein incorporated by reference including: a patent application having the attorney docket number 000174-0556, which is a continuation in part application of U.S. patent application Ser. No. 08/751,447 filed on Nov. 18, 1996, now pending, which is a continuation of a U.S. application Ser. No. 08/510,085 filed Aug. 1, 1995, now U.S. Pat. No. 5,575,719, which is a divisional application of U.S. application Ser. No. 08/209,169 filed Feb. 24, 1994, now U.S. Pat. No. 5,501,463, which is a continuation of U.S. application Ser. No. 07/979,712 filed Nov. 20, 1992, now abandoned.

However, the present invention is not limited to these instruments as it can be used for any device requiring selective, rapid activation of a flashlamp. Preferably, a predetermined time period of about 100 $\mu$s separates successive flashlamp activating pulses to enable accurate measurement of the movement of the golf club head and golf ball while avoiding holdover within the flashlamp. Preferably, the flashlamp activating pulses have a width of about 200 ns per inch of the arc length of the flashlamp.

Figure 5A:
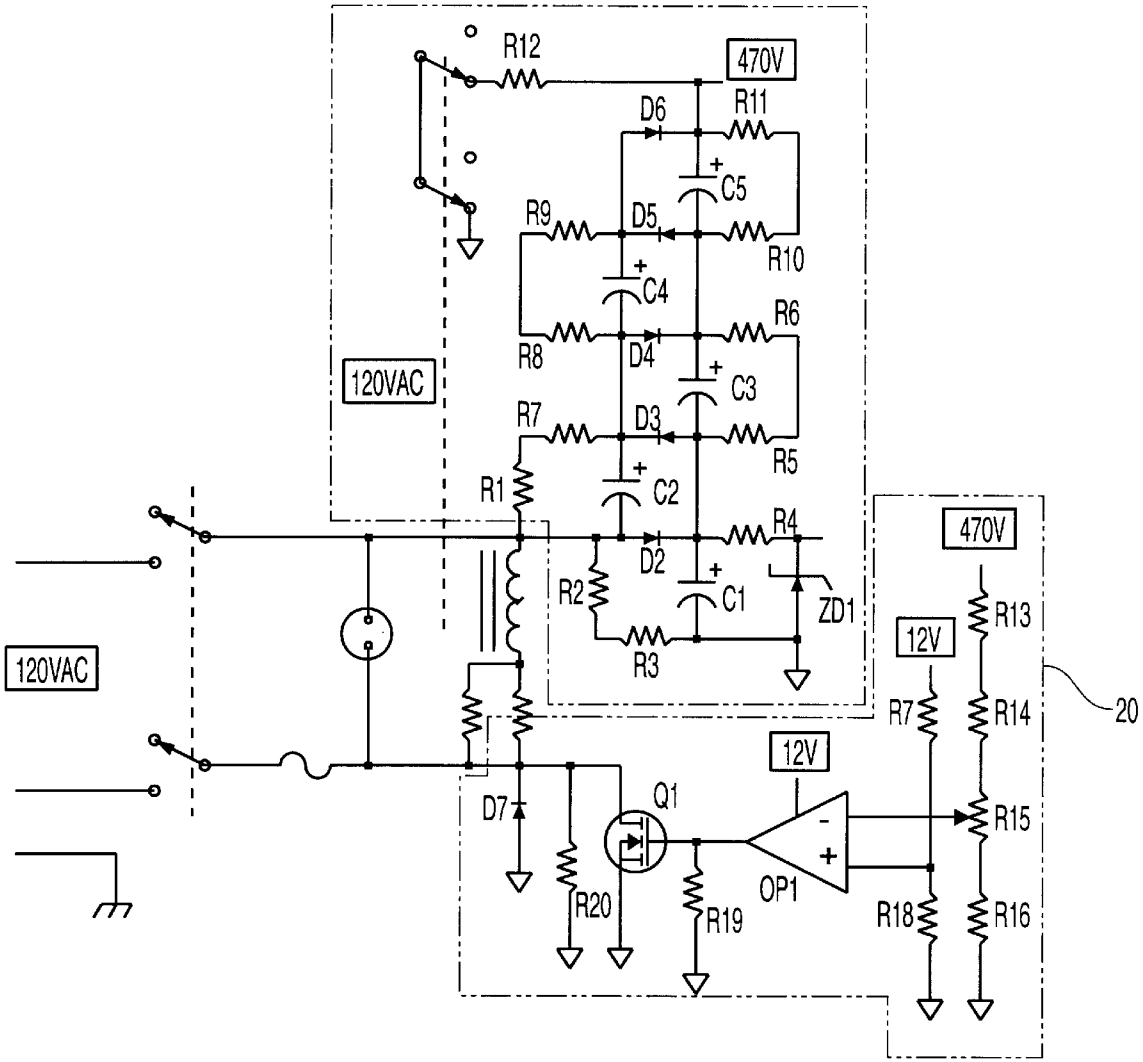
FIG. 5 provides a circuit diagram in accordance with the present invention for controlling a flash lamp.
Figure 5B:
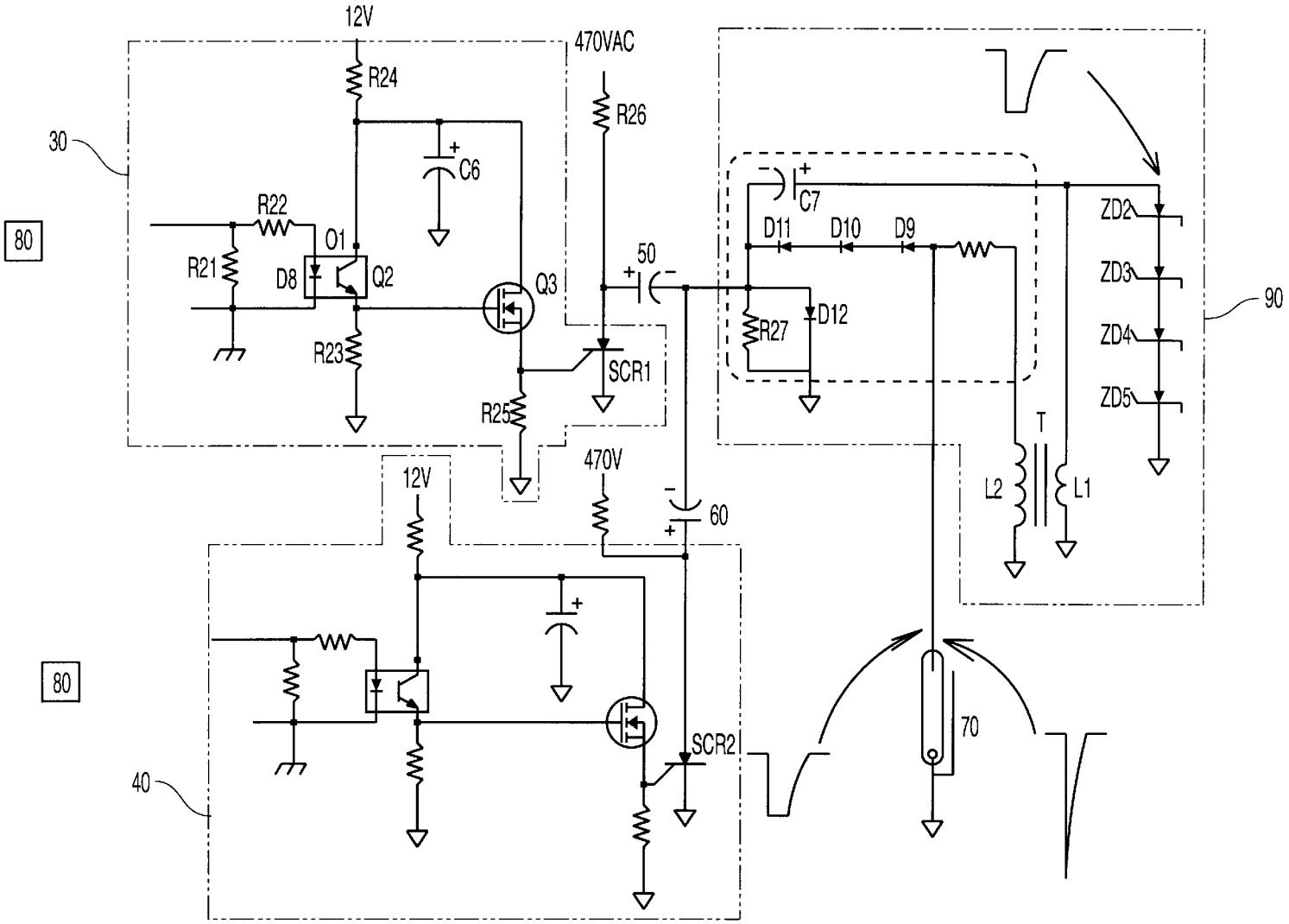

FIGS. 5A and 5B provide an analog circuit implementation of the present invention which controls the multiple flashing of a lamp. The circuit of FIGS. 5A and 5B comprise the aforementioned flashlamp 70, a pair of capacitors 50, 60, a voltage rectifier and multiplier 10 and a voltage regulator 20 to charge the capacitors 50, 60, a pair of trigger circuits 30, 40, an external controller 80 to selectively activate each trigger circuit 30, 40 to activate the flashlamp 70, and a flashlamp discharge circuit 90 to discharge the capacitors 50, 60 across the flashlamp 70.

The voltage rectifier and multiplier 10 converts the 120 volt ac amplitude waveform to a 470 volt amplitude rectified waveform. Preferably, the voltage rectifier and multiplier 20 is a half-wave tripler. The voltage rectifier and multiplier 10 comprises a plurality of diodes, a plurality of resistors and a plurality of capacitors arranged so that alternating diodes conduct on different portions of the input waveform voltage and alternating capacitors accumulate charge on different portions of the input waveform voltage. The ac voltage source, a bleeder resistor R1, a bleeder resistor R2, a capacitor C2 and a diode D2 are connected. The bleeder resistor R2 and a bleeder resistor R3 are connected. The bleeder resistor R3, a capacitor C1 and a Zener diode ZD1 are connected. The diode D2, a diode D3, a capacitor C3, a bleeder resistor R5, the bleeder resistor R4 and the capacitor C1 are connected.

The resistor R4 and the Zener diode ZD1 are connected. The bleeder resistor R1 and a bleeder resistor R7 are connected. The bleeder resistor R7, a bleeder resistor R8, a capacitor C4, a diode D4, the diode D3, and the capacitor C2 are connected. The bleeder resistor R5 and a bleeder resistor R6 are connected. The bleeder resistor R8 and a bleeder resistor R9 are connected. The bleeder resistor R9, a diode D6, the diode D5, and the capacitor C4 are connected. The diode D4, the diode D5, a capacitor C5, a bleeder resistor R10, the bleeder resistor R6, and the capacitor C3 are connected. The diode D6, the capacitor C5, a capacitor discharge resistor R12, and a bleeder resistor R11 are connected. The bleeder resistor R10 and the bleeder resistor R11 are connected.

When the ac power supply is applied to the circuit, diode D2 conducts on the positive portion of the waveform and diode D3 conducts on the negative portion of the waveform. Accordingly, capacitor C1 accumulates charge on the positive portion of the waveform and capacitor C2 accumulates charge on the negative portion of the waveform. Similarly, diode D4 conducts on the positive portion of the input waveform while diode D5 conducts on the negative portion of the input waveform. Accordingly, capacitor C3 accumulates charge on the positive portion of the input waveform and capacitor C4 accumulates charge on the negative portion of the input waveform. Capacitor C5 accumulates charge on the positive portion of the input waveform. Accordingly, the voltage multiplier will create a rectified and amplified waveform across its capacitors from the input waveform provided at its input.

Preferably, capacitors C1, C2, C3, C4 and C5 are 100 mf capacitors, having a voltage capacity of 250 Vdc available as part number P6192 from Panasonic. Diodes D1, D2, D3, D4, D5 and D6, having a voltage capacity of 1 kv and a current capacity of 1 a, are available from Diodes Inc. as Part Number 1N4007. Bleeder resistors R1, R2, R3, R5, R6, R7, R8, R9, R10, and R11 are 220K carbon film resistors, having a power capacity of ¼ w, available from Yageo. The discharge resistor R12 is a 20 k resistor, having a power capacity of 5 w, available from Ohmite. Zener diode ZD1 is a 1N4742A, available from Diodes Inc., and yields a reference voltage of 12 V and has a current capacity of 21 ma. Capacitor 50 is a 20 mf capacitor, having a voltage capacity of 580 Vac, available from General Electric Dielektrol as part number 97F8253. Capacitor 60 is a 10 mf capacitor, having a voltage capacity of 580 Vac, available from General Electric Dielektrol as part number 97F849S. The relay is a DPDT 120 vac coil available from Potter Brmfield as part number KA11AY. The switch is a toggle, DPDT, available from C&K. The fuse is a 3 AG, 1 a/250 v/slo fuse, available from Littlefuse as part number F319.

The voltage rectifier and multiplier 10 reduces package dimensions after an apparent limit is reached by the more usual techniques of high-frequency switching and elimination of 60 Hz magnetics. Further, the voltage rectifier and multiplier 10 provides additional output voltage using only a single-secondary transformer. Although poor regulation is not a big problem with the voltage rectifier and multiplier 10, superb regulation is not necessary for use in a system where the ultimate regulation of dc output is taken care of by the feedback loop of the voltage regulator 20. Thus, the voltage rectifier and multiplier 10 is used in the unregulated power supply and precedes the feedback loop of the voltage regulator 20. Specifically, the 60 Hz line is immediately rectified and filtered by the voltage rectifier and multiplier 10, which in turn, provides the dc input voltage to the voltage regulator 20. This technique enables very high output voltages to be attained without 60 Hz magnetics. See Power Supplies, Switching Regulators, Inverters & Converters, Irving Gottlieb, TAB Books Inc., 1976 ("Power Supplies"), pg. 374–377.

Since the voltage rectifier and multiplier 10 operates on the peak value of the input voltage sine waveform, it will more than triple the input voltage as the capacitors C1, C2, C3, C4, C5 are large and the load is relatively light. See Power Supplies, pg. 374–377.

The voltage rectifier and multiplier 10 is designed to have a minimum ΩCR product of 100, where Ω is 2π times the operating frequency in hertz, C is the capacitance value in farads, and R is the effective resistance in ohms presented by the heaviest load which will be imposed. This will result at least in 90 percent of the attainable dc voltage, and it will confine the operation to a relatively flat portion of the regulation characteristic. See Power Supplies, pg. 374–377.

Zener diode ZD1 operates to provide a 12 V supply to various locations in the circuit including the power supply of the operational amplifier OP1, the reference voltage of the operational amplifier OP1 and the power supply for the trigger circuits 30, 40. As is known to persons of ordinary skill in the art, Zener diodes provide a fixed voltage drop along with a low resistance path for alternating currents and protect I/O terminals from excessive voltage. See Holt, Section 1.9.

The voltage regulator 20 provides voltage regulation of the voltage supplied by the voltage rectifier and multiplier 10 using a sampling and feedback arrangement as shown in FIG. 4. The output of the voltage rectifier and multiplier 10 is connected to a resistor R13. The resistor R13 is also connected to a resistor R14. The resistor R14 is also connected to a resistor R15 which is also connected to a resistor R16 and the inverting input of the operational amplifier OP1. The reference voltage provided by the Zener diode ZD1 is connected to a resistor R17 which is also connected to a resistor R18 and the noninverting input of operational amplifier OP1. The output of the operational amplifier OP1 is connected to a resistor R19 and to the gate of an n-channel, enhancement mode MOSFET Q1. The drain of the MOSFET Q1 is connected to a diode D7, a resistor R20 and to the ac power supply.

Preferably, Ql is an enhancement mode n-channel MOS Field Effect Transistor (NMOSFET), available from International Rectifier as Part Number IRFB20. The enhancement mode NMOS device shows significant conduction between source and drain only when an n-channel exists under the gate. This is the origin of the n-channel designation. The term, enhancement mode refers to the fact that no conduction occurs when $V_{gs}$ equals zero, and thus, the channel must be enhanced to cause conduction. See Analysis and Design of Analog Integrated Circuits, Paul R. Gray and Robert G. Meyer, John Wiley & Sons, 1984, (Gray and Meyer) Section 1.7.

Preferably, resistors R13 and R14 are 1M carbon film resistors, having a power capacity of ½ w, available from Yageo. Resistor R15 is a 10K Trimpot, available from Bourns as Part Number 3386P-103. Resistor R16 is a 22K carbon film resistor, having a power capacity of ¼ w, available from Yageo. Resistors R17 and R18 are 220K carbon film resistors, having a power capacity of ¼ w, available from Yageo. Operational amplifier OP1 is available from National Semiconductor as Part Number LM324AN. Resistors R19 and R20 are 220K carbon film resistors, having a power capacity of ¼ w, available from Yageo. Diode D7, having a voltage capacity of 1 kv and a current capacity of 1 a, is available from Diodes Inc. as Part Number 1N4007.

The operational amplifier OP1 compares a reference voltage supplied to its non-inverting input I1 to the voltage sampled from the output of the voltage rectifier and multiplier 10 supplied to the inverting input I2. When the sampled voltage provided to the inverting input I2 of the operational amplifier OP1 falls below the reference voltage provided to the non-inverting input I1 of the operational amplifier OP1, current does not flow between the source and the drain of MOSFET Q1 because MOSFET Q1 is off because its gate voltage is not sufficiently high to produce a channel from the source to the drain.

The gate voltage of MOSFET Q1 is not sufficiently high to produce a channel from the source to the drain when the sampled voltage at the inverting input of the operational amplifier OP1 falls below the reference voltage at the non-inverting input because the operational amplifier OP1 does not apply voltage to the gate of Q1. The operational amplifier OP1 does not apply voltage to the gate of Q1 when the sampled voltage falls below the reference voltage because the sampled voltage is provided to the inverting input of the operational amplifier OP1 while the reference voltage is provided to the non-inverting input.

The operational amplifier is a direct-coupled high-gain amplifier to which feedback is added to control its overall response characteristic. The operational amplifier used in the voltage regulator 20 has a differential input, with different voltages applied to the inverting and noninverting terminals. The gain between the output and the noninverting terminal is positive and the gain between the output and the inverting terminal is negative. The ideal operational amplifier has an infinite input resistance, a null output resistance, an infinite voltage gain, an infinite bandwidth, and a zero common mode rejection ratio. The common mode rejection ratio is the ratio of the voltage gain for the difference signal $A_d$ to the voltage gain for the common-mode signal $A_c$ where $v_d=v_1-v_2$, $v_c=\frac{1}{2}(v_1+v_2)$, and $v_o=A_d v_d+A_c v_c$. At the input to the operational amplifier, there exists a virtual ground or virtual short circuit. The term virtual implies that no current actually flows into the short circuit even though the feedback from output to input serves to keep the $V_i$ equal to zero. See Millman, Section 15-1.

As the output of the voltage rectifier and multiplier 10 begins to increase to charge the capacitors 50, 60, current flows through the MOSFET Q1 because Q1 is on as its gate voltage is sufficiently high to produce a channel from the source to the drain. The gate voltage of MOSFET Q1 is sufficiently high to produce a channel from the source to the drain because the operational amplifier applies voltage to the gate of MOSFET Q1 when the sampled voltage equals the reference voltage.

Figure 6:
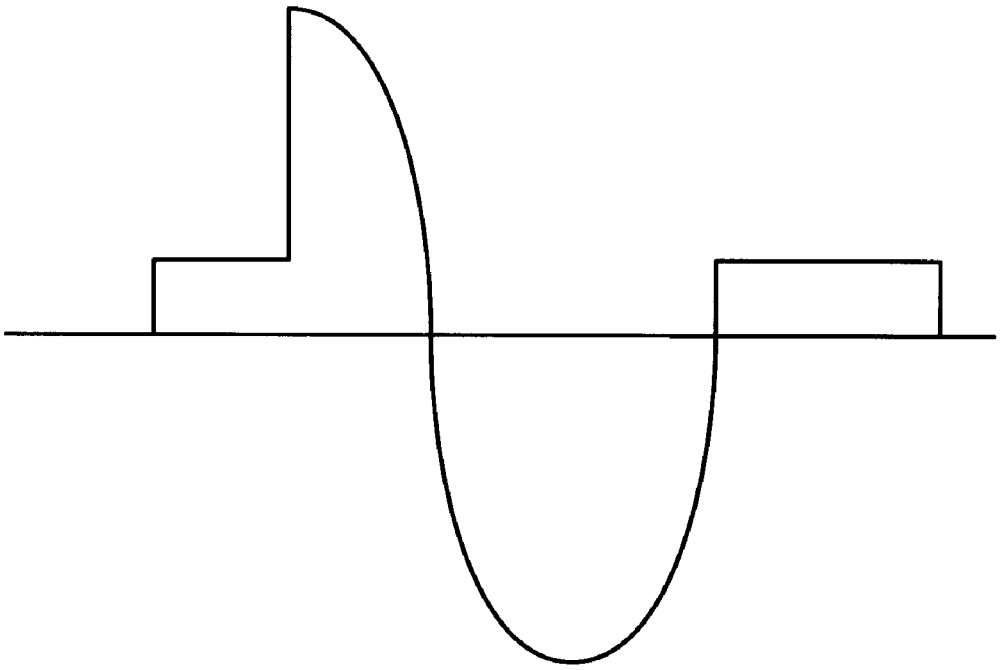
FIG. 6 displays the voltage waveform produced by a voltage regulator.
Figure 7A:
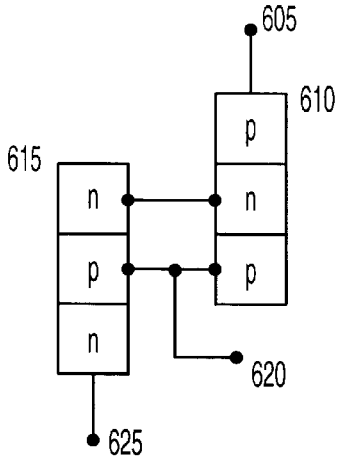
FIG. 7A PRIOR ART
FIGS. 7A–7D show physical and circuit models of a thyristor called the silicon controlled rectifier.
Figure 7B:
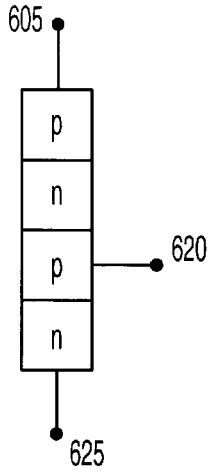
FIG. 7B PRIOR ART
Figure 7C:
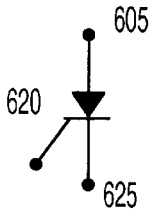
FIG. 7C PRIOR ART
Figure 7D:
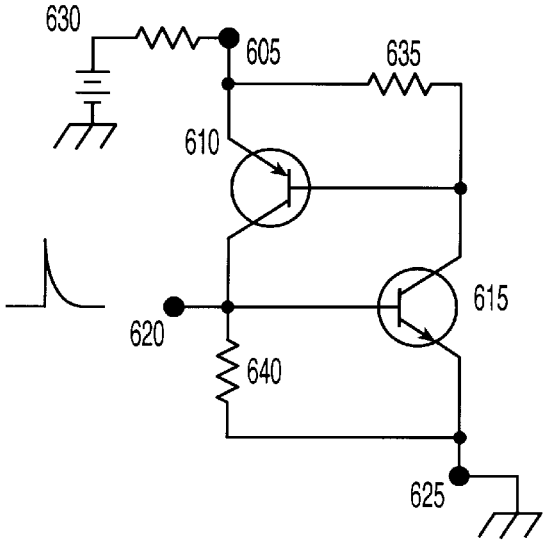
FIG. 7D PRIOR ART

Accordingly, the operational amplifier OP1 and the n-channel enhancement mode MOSFET Q1 function as described above to produce the voltage waveform shown in FIG. 6. As shown by FIG. 6, the operational amplifier OP1 and the MOSFET Q1 operate to clip the positive portion of the ac voltage supply when the sampled voltage equals the reference voltage. Conversely, the operational amplifier OP1 and the MOSFET Q1 operate to pass the positive portion of the ac voltage supply when the sampled voltage falls below the reference voltage. Thus, the voltage regulator 20 passes the full ac input voltage waveform when the sampled voltage falls below the reference voltage to enable the voltage rectifier and multiplier 10 to increase its output to charge capacitors 50, 60. Conversely, the voltage regulator 20 clips the positive portion of the ac input voltage waveform when the sampled voltage equals the reference voltage since the full waveform is not required by the voltage rectifier and multiplier 10 when its output is sufficiently high to charge capacitors 50, 60.

The resistors R19, R20 serve to bias the enhancement mode n-channel MOSFET. The enhancement mode n-channel MOSFET functions most linearly when it is constrained to operate in its active region. To establish an operating point in this region it is necessary to provide appropriate direct potentials and currents, using external sources. Once an operating point Q is established, time-varying excursions of the input signal (the gate voltage, for example) should cause an output signal (source-drain current) of the same waveform. If the output signal is not a faithful reproduction of the input signal, for example, if it is clipped on one side, the operating point is unsatisfactory and should be relocated on the transistor's characteristics. The selection of an appropriate operating point ($I_D$, $V_{gs}$, $V_{ds}$) for a FET amplifier stage is determined by considerations such as output voltage swing, distortion, power dissipation, voltage gain, and drift of drain current. See Gray and Meyer, Section 1.7.

After the capacitors 50, 60 are charged by operation of the voltage rectifier and multiplier 10 and the voltage regulator 20, the external controller 80 provides a signal to activate the first trigger circuit 30 and the second trigger circuit 40 at input FL1 and FL2 respectively to activate the flashlamp 70.

The external controller 80 is connected to a resistor R21 and a resistor R22. The resistor R21 is also connected to ground. The resistor R22 is connected to an optoisolator O1. The optoisolator O1 comprises a light emitting diode LED1 and an npn bipolar phototransistor Q2. The 12 V power supply provided by Zener diode ZD1 is connected to a resistor R24. The collector of the phototransistor Q1 is connected to the resistor R24, a capacitor C6, and the drain of an n channel enhancement mode MOSFET Q2. The emitter of the phototransistor is connected to a resistor R23 and the gate of the MOSFET Q2. The source of the MOSFET Q2 is connected to a resistor R25 and to the gate of a silicon controlled rectifier SCR1. The output of the voltage rectifier and multiplier 10 is connected to a resistor R36. The resistor R36 is also connected to the anode of the silicon controlled rectifier SCR1 and the capacitor 50. The cathode K of the silicon controlled rectifier SCR1 is connected to the common point.

Preferably, resistor R21 is a 2.2M carbon film resistor, having a power capacity of ¼ w, available from Yageo. Resistor R22 is a 2.2 k carbon film resistor, having a power capacity of ¼ w, available from Yageo. Resistors R23 and R24 are 220 k carbon film resistors, having a power capacity of ¼ w, available from Yageo. Resistor R25 is a 10 ohm carbon film resistor, having a power capacity of ¼ w, available from Yageo. Resistor R26 is a 20 k resistor, having a power capacity of 5 w, available from Ohmite. The optoisolator O1 is available from NEC as Part Number PS2501-1. Capacitor C6 is a 10 mf capacitor, having a voltage capacity of 50 Vdc, available as part number P6650 from Panasonic. The n-channel enhancement mode MOSFET Q3 is available from International Rectifier as Part Number IRFD113. The silicon controlled rectifier SCR1, having a voltage capacity of 800 v and a current capacity of 55 a, is available from Motorola as Part Number MCR265-10.

FIGS. 7A–7D show physical and circuit models of a thyristor called the silicon controlled rectifier having an anode 605, a gate 620 and a cathode 625. Thyristors enable the control of load power by interrupting the flow of load current. The silicon controlled multiplier comprises a pnp transistor 610 a npn transistor 615 and resistors 630, 635, 640 having an exemplary resistance of 1 kΩ connected as shown in FIGS. 7A–7D. The trigger circuits 30, 40 use the silicon controlled rectifier as the thyristor to selectively control the discharge of capacitors 50, 60 to the flashlamp 70. Silicon controlled rectifiers along with triacs are the thyristors which are often used in switching-type power supplies are the SCR and the triac, although other pnp devices can also be used for triggering and timing. The silicon controlled rectifier operates as a driven switch with its conductivity at all times dependent upon actuating drive. The thyristor operates as a regenerative switch triggered from its off to its on state by a short-duration pulse. Once triggered, the thyristor supplies its own gate drive and very rapidly goes into saturation, thereafter, the gate loses its control entirely. It does not matter if subsequent trigger pulses are delivered to the gate or if the gate is disconnected from the circuit. Once the thyristor is in its on state, it is latched as a closed switch. See Power Supplies, pg. 313–324.

The thyristor remains on until the current through it is either interrupted or reduced below a relatively low value-the so-called holding current. The thyristor then reverts to its nonconductive or off state. Having thus been reset, it is again receptive to a gate trigger pulse.

The two-transistor configuration model pictured in FIGS. 7A–7D closely duplicates the actual operation of the silicon controlled rectifier. The silicon controlled rectifier operates as a latching binary, or flip-flop, in which one state change (off to on) is provoked by a gate trigger pulse, and the alternate change of state (on to off) is brought about by the next zero crossing of the ac input wave. See Power Supplies, pg. 313–324.

The useful behavior of the SCR stems directly from the fact that α, which is the current transfer figure of merit in transistors, is a function of emitter current. α is simply the ratio of output (collector) current to input (emitter) current with the transistor in the common-base circuit. The concept of α can be used to describe relationships in transistor circuits other than the common-base configuration, as in the dual-transistor circuit of FIGS. 7A–7D. Since neither transistor has any forward-biasing arrangement, the stage is in its nonconductive state. Although a leakage current ($I_{co}$) provides some forward-bias current to the base-emitter junction of the npn transistor, the α developed by this transistor at such low currents is too low to start any chain of events in the overall circuitry. Thus, this transistor and the pnp transistor are off. See Power Supplies, pg. 313–324.

The injection of a short-duration positive trigger into the gate terminal provokes a drastic change in the circuit. The npn transistor has its α momentarily increased and thereby its collector current. This also serves to increase the forward-bias current of the npn transistor which turns it on. The resultant collector current of the pnp transistor reinforces the forward base-emitter bias of the npn transistor, whether or not the gating pulse still exists. Once initiated, both transistors are speedily transferred into their conductive states. Since one transistor reinforces the on state of the other, the entire circuit latches in the on state, allowing full current to be delivered to the load. In this latched state, trigger pulses have no further effect, and even a negative pulse applied to the gate will usually have no effect. To restore the circuit to its off state, the current must be momentarily interrupted either at the cathode or anode. See Power Supplies, pg. 313–324.

The load current increases substantially as the sum of the two individual as approaches unity, at which point the load current is determined entirely by the circuit's own resistance. The transistor circuit then behaves as a closed switch. Of course, neither this circuit nor the thyristor structure it simulates has zero resistance or zero voltage drop in its on state, but since both transistors are in hard saturation, the voltage drop across the anode/cathode terminals of the device is relatively low. Active or "hot" transistors are those in which α closely approaches unity. However, even relatively poor junction devices having alphas considerably less than unity, can participate in the regenerative process which requires only that the sum of the current transfer ratios attain unity. See Power Supplies, pg. 313–324.

The di/dt value must be kept within bounds for proper operation of the silicon controlled rectifier. The di/dt value is the initial rate at which anode to cathode current increases following turn on. Lifespan and reliability are adversely affected if this rate is excessive. The di/dt value can be slowed down by means of a small amount of series inductance. The circuit should also have good heat removal. Silicon controlled rectifiers are available in different constructions, gate geometries, and packages. See Power Supplies, pg. 313–324.

The gate turn-on characteristics of silicon controlled rectifiers play an important role in both the turn-on time and the amount of dissipation that the silicon controlled rectifiers incur during the turn on transition. Manufacturers typically give both minimum and maximum values for gate turn-on voltages and currents. While it might seem desirable to select gate-drive parameters that favor the minimum side of the specifications, this results in slower turn-on times which inevitably lead to increased dissipation, particularly at higher operating frequencies. It is true that increased drive values also increase the amount of dissipation in the gate circuit of the SCR, but it is the total amount of power dissipated in the SCR that is most important. Consequently, it is actually easier on the SCR to provide near-maximum values of gate-triggering pulses. See Power Supplies, pg. 313–324.

Before activation of the first trigger circuit 30 by the external controller 80 at input FL1, the silicon controlled rectifier SCR1 is off. Capacitor 50 does not discharge through the flashlamp 70 when SCR1 is off because SCR1 interrupts the flow of current when it is off. SCR1 is off before activation of the first trigger circuit 30 by the external controller 80 because the n-channel enhancement mode MOSFET Q3 does not provide a voltage to the gate of SCR1 which is sufficiently high to turn SCR1 on because Q3 is off. Q3 is off before activation of the first trigger circuit 30 because the phototransitor Q2 of the optoisolator O1 does not provide a voltage to the gate of Q1 as the phototransistor Q2 is off. When phototransistor Q2 is off, the n-channel enhancement mode MOSFET Q3 is off because the voltage at the gate of Q3 is not sufficiently high to create an n-type channel under the gate. Accordingly, no conduction occurs through the MOSFET Q3 when phototransistor Q2 is off. The phototransistor Q2 is off because current does not flow through the adjacent light emitting diode D8 of the optoisolator O1 before activation of the first trigger circuit by the external controller 80. Accordingly, when diode D8 is off, phototransistor Q2 is off because its base-emitter junction is not forward biased. Current does not flow through D8 because diode D8 is off as its pn junction is not forward biased.

The external controller 80 activates SCR1 by supplying a pulse at input FL1 to an optoisolator O1. The pulse at FL1 causes the diode D8 to turn on because the voltage across the pn junction becomes sufficiently high to forward bias the diode D8. With diode D8 on, current flows through the current limiting resistor R22 and through the diode D8. The current flowing through diode D8 turns the phototransistor Q2 on because it causes the voltage across the base-emitter junction to become sufficiently high to forward bias the pn junction. With phototransistor Q2 on, a collector current flows from the collector of phototransistor Q2 to the emitter of phototransistor Q2. The collector current causes the voltage to rise at the emitter of the phototransistor Q2.

The voltage at the emitter of the phototransistor Q2 causes the n-channel enhancement mode MOSFET Q3 to turn on because the voltage at the gate of Q3 becomes sufficiently high to produce a channel from the source to the drain. The current through the MOSFET Q3 causes the voltage at the gate of the silicon controlled register SCR1 to rise. The voltage at the gate of SCR1 causes SCR1 to turn on and to provide a path for the discharge of current from capacitor 50 to the cathode of the flashlamp 70.

As shown by FIGS. 5A and 5B, the second trigger circuit 40 comprises the same components connected in the same manner as the first trigger circuit 30. The external controller 80 provides a pulse to the input of the second trigger circuit 40 at FL2 to discharge the capacitor 60 across the flashlamp 70 to activate the flashlamp 70. Accordingly, the external controller 80 can activate the flashlamp 70 again after the discharge of the first capacitor 50 without waiting for the first capacitor 50 to accumulate charge. Thus, the circuit of the present invention can successively activate the flashlamp 70 with only a minimal amount of time between flashes.

The flashlamp discharge circuit 90 discharges the capacitors 50, 60 across the flashlamp 70. The flashlamp discharge circuit 90 comprises a linear transformer T having a primary inductor L1 formed by a first coil and a secondary inductor L2 formed by a second coil. The transformer's operation is based inherently on mutual inductance. The transformer T contains two or more coils which are deliberately coupled magnetically. Current flowing through the first coil L1 of the transformer T establishes a magnetic flux about that coil L1 and also about the second coil L2 which is in the vicinity of the first coil L1. The time-varying flux surrounding the second coil L2 produces a voltage across the terminals of the second coil L2 which is proportional to the time rate of change of the current flowing through the first coil L1. The transformer T is used to increase the amplitude of the voltage appearing across the first coil L1. Preferably, the transformer, having a turns ratio of 100:1, is a TR-180B, available from EG & G Electro-optics. See Engineering Circuit Analysis, William H. Hayt and Jack E. Kemmerly, McGraw-Hill Book Company, 1979 (Hayt), Chapter 15.

The primary coil L1 is connected to a series of four Zener diodes ZD2, ZD3, ZD4, ZD5 and a capacitor C7. The capacitor C7 is also connect to the capacitor 50, the capacitor 60, a series of diodes D11, D10, D9, a resistor R27, and a diode D12. The second coil L2 is connected to a resistor R28. The resistor R28 is also connected to the series of diodes D9, D10, D11 and the anode of the flashlamp 70. The cathode of the flashlamp 70 is connected to the common point.

Preferably, each of the Zener diodes ZD2, ZD3, ZD4, ZD5, available from Diodes Inc. as Part Number 1N4756A, provide a reference voltage of 47 V and have a current capacity of 55 ma. Capacitor C7 is a 0.1 mf capacitor with a voltage capacity of 630 Vdc, available as part number DMM6P1K from Cornell-Dubilier. The resistor R28 is a 5 k resistors, having a power capacity of 10 w, available from Ohmite. Each of the diodes D9, D10, D11, available from EDI as part number 3W3, has a voltage capacity of 3 kv and a current capacity of 1 a. The resistance R27 is a 4.7 k resistor, having a power capacity of 10 w, available from Ohmite. The diode D12, having a voltage capacity of 1 kv and a current capacity of 1 a, is available from Diodes Inc. as Part Number 1N4007. The flashlamp 70 is a Xenon 2.4"×5 mm flashlamp, available from EG & G Electro-Optics as Part Number FXQSL-1077-0.75.

After the voltage rectifier and multiplier 10 and the voltage regulator 20 charge capacitors 50, 60 and before the external controller 80 provides a pulse to the trigger circuits 30, 40, a negative charge accumulates on the side of the capacitor C7 which is connected to capacitors 50, 60 which is equal in magnitude to the positive charge which has accumulated on the capacitors 50, 60. When the external controller 80 provides a pulse to a trigger circuit 30, 40 to turn on the silicon controlled rectifier SCR1, SCR2 respectively, a voltage pulse appears across the primary coil L1 of the transformer T to allow the positive charge on one side of C7 to equal the magnitude of the negative charge on the other side of C7. The Zener diodes ZD2, ZD3, ZD4, ZD5 limit the magnitude of the trigger pulse appearing across the primary coil L1 of the transformer T to limit the peak current to the flashlamp 70 to extend the life of the flashlamp 70 as previously discussed. Preferably, the Zener diodes ZD2, ZD3, ZD4, ZD5 limit the magnitude of the trigger pulse appearing across the primary coil L1 of the transformer T to 188 V.

The transformer T operates to amplify the voltage appearing across the primary coil L1 to the secondary coil L2. Since the secondary coil L2 and the flashlamp 70 are connected in parallel, the appearance of a voltage pulse across the secondary coil L2 of the transformer T causes a voltage pulse to appear across the anode and cathode of the flashlamp 70. Preferably, the transformer operates to apply a voltage trigger pulse with a magnitude of 10 kV across the anode and cathode of the flashlamp 70. The voltage trigger pulse initiates conduction across the flashlamp 70 by creating a small arc streamer between the anode and the cathode of the flashlamp 70. As the impedance across the flashlamp 70 drops, current flows from capacitor 50, 60 through the silicon controlled rectifiers SCR1, SCR2 respectively through the flashlamp 70 and through the diodes D9, D10, D11 to the capacitor 50, 60 respectively.

In addition to carrying the discharge current, the diodes D9, D10, D11 act as blocking diodes to prohibit the trigger voltage from appearing across the discharge capacitor 50, 60. The diode D12 acts to prevent a negative current swing through the flashlamp which results in a ringing condition if the capacitor discharge circuit 90 is underdamped. Accordingly, diode D12 eliminates the adverse effects of current reversal.

While the above invention has been described with reference to certain preferred embodiments, the scope of the present invention is not limited to these embodiments. One skilled in the art may find variations of these preferred embodiments which, nevertheless, fall within the spirit of the present invention, whose scope is defined by the claims set forth below.

What is claimed is:

1. An electrical circuit for selectively strobing a flashlamp comprising:

a flashlamp;

at least two capacitors each of said at least two capacitors holding a corresponding charge;

a power source for providing the charge to said at least two capacitors;

a discharge circuit;

at least two trigger circuits wherein each of said at least two trigger circuits discharges a corresponding one of said at least two capacitors across said flashlamp through said discharge circuit for providing an activating pulse to said flashlamp, at least one of said at least two capacitors holding the corresponding charge after another one of said at least two capacitors has discharged for rapid strobing of said flashlamp; and an external controller for activating said at least two trigger circuits for activating said flashlamp with a trigger pulse.

2. An electrical circuit of claim 1 wherein a predetermined time period of about 100 $\mu$s separates successive ones of the activating pulses.

3. An electrical circuit of claim 1 wherein the activating pulses have a width of about 200 ns per inch of an arc length of said flashlamp.

4. An electrical circuit of claim 1 wherein said power source comprises:

an alternating current power source;

a voltage rectifier and multiplier for converting said alternating current power source to a direct current voltage at a predetermined magnitude; and a voltage regulator for maintaining the direct current voltage at the predetermined magnitude.

5. An electrical circuit of claim 1 wherein each of said at least two trigger circuits comprises:

a silicon controlled rectifier having a gate, an anode, and a cathode, for selectively providing a discharge path from said corresponding one of said at least two capacitors to said flashlamp;

a field effect transistor having a gate, a source and a drain wherein said drain is connected to a drain capacitor and said source is connected to a source resistor, said field effect transistor selectively providing a voltage from said drain capacitor to said gate of said silicon controlled rectifier; and an optoisolator having an optically connected light emitting diode and a phototransistor, said phototransistor having an emitter resistor, for selectively providing a voltage to said gate of said field effect transistor upon receiving the trigger pulse from said external controller.

6. An electrical circuit of claim 1 wherein said discharge circuit comprises:

a transformer having a primary coil and a secondary coil connected in parallel with said flashlamp, said primary coil selectively connected to said at least two capacitors for amplifying the trigger pulse from said external controller across said secondary coil;

a plurality of zener diodes connected to said primary coil for limiting an amplitude of the trigger pulse across said secondary coil to limit a current through said flashlamp to a predetermined level;

a primary coil capacitor connected to said primary coil for producing the trigger pulse across said primary coil;

a plurality of blocking diodes connected to said flashlamp and to said secondary coil for providing a discharge path from said at least two capacitors to said flashlamp and for prohibiting the trigger pulse from appearing across said at least two capacitors; and a shunt diode connected to said at least two capacitors and connected to said plurality of blocking diodes for preventing a negative current swing through said flashlamp.

7. A circuit as in claim 4 wherein said voltage rectifier and multiplier comprises:

a plurality multiplier of capacitors for storing energy during a conduction period and for delivering energy to said at least two capacitors during a non-conducting period;

a plurality of multiplier diodes for alternatively charging said plurality of capacitors to a peak voltage of said alternating current power source;

a plurality of bleeder resistors for delivering energy to said at least two capacitors during the non-conducting period; and a zener diode for producing a reference voltage.

8. The electrical circuit of claim 4 wherein said voltage regulator comprises:

an operational amplifier having a first input, a second input and an output, said first input connected to receive a sample voltage from said voltage rectifier and multiplier, said second input connected to receive a reference voltage, said output producing an error signal;

a field effect transistor having a drain, a source, and a gate, for passing said alternating current power source when the sample voltage is less than the reference voltage and for clipping a portion of said alternating current power source when the sample voltage is equal to the reference voltage, said gate connected to said output of said operational amplifier wherein said field effect transistor conducts current when said output of said operational amplifier is high and said field effect transistor does not conduct the current when said output of said operational amplifier is low; and a first resistor connected to said gate of said field effect transistor and a second resistor connected to said drain of said field effect transistor for biasing said field effect transistor.

9. A method for selectively strobing a flashlamp with an electrical circuit comprising the steps of:

providing a charge with a power source;

holding the charge with at least two capacitors;

discharging one of the capacitors with a corresponding one of at least two trigger circuits through a discharge circuit to provide an activating pulse to a flashlamp wherein at least another of the at least two capacitors holds the charge after discharging the one of the capacitors for rapid strobing of the flashlamp; and activating the at least two trigger circuits with a trigger pulse with an external controller to activate the flashlamp.

10. A method for selectively strobing a flashlamp with an electrical circuit as in claim 9 wherein a predetermined time period of about 100 $\mu$s separates successive ones of the activating pulses.

11. A method for selectively strobing a flashlamp with an electrical circuit as in claim 9 wherein the activating pulses have a width of about 200 ns per inch of an arc length of the flashlamp.

12. A method for selectively strobing a flashlamp with an electrical circuit as in claim 9 wherein said providing a charge step comprises the steps of:

providing power with an alternating current power source;

converting the alternating current power source to a direct current voltage at a predetermined magnitude with a voltage rectifier and multiplier; and maintaining the direct current voltage at the predetermined magnitude with a voltage regulator.

13. A method for selectively strobing a flashlamp with an electrical circuit as in claim 9 wherein said discharging one of the capacitors step comprises the steps of:

selectively providing a discharge path from the one of the at least two capacitors to the flashlamp with a silicon controlled rectifier having a gate, an anode, and a cathode;

connecting a field effect transistor having a gate, a source, and a drain with the silicon controlled rectifier wherein the drain is connected to a drain capacitor and the source is connected to a source resistor;

selectively providing a voltage from the drain capacitor to the gate of the silicon controlled rectifier with the field effect transistor; and selectively providing a voltage to the gate of the field effect transistor upon receiving the trigger pulse from the external controller with an optoisolator having an optically connected light emitting diode and a phototransistor, the phototransistor connected to an emitter resistor.

14. A method for selectively strobing a flashlamp with an electrical circuit as in claim 9 wherein said discharging one of the capacitors step further comprises the steps of:

connecting a transformer having a primary coil and a secondary coil in parallel with the flashlamp wherein the primary coil is selectively connected to the at least two capacitors;

amplifying the trigger pulse from the external controller with the transformer across the secondary coil;

limiting an amplitude of the trigger pulse across the secondary coil to limit a current through the flashlamp to a predetermined level by connecting a plurality of zener diodes to the primary coil;

producing the trigger pulse across the primary coil by connecting a primary coil capacitor to the primary coil;

providing a discharge path from the at least two capacitors to the flashlamp and prohibiting the trigger voltage from appearing across the at least two capacitors by connecting a plurality of blocking diodes to the flashlamp and to the secondary coil; and preventing a negative current swing through the flashlamp by connecting a shunt diode to the at least two capacitors and to the plurality of blocking diodes.

15. A method for selectively strobing a flashlamp with an electrical circuit as in claim 12 wherein said converting the alternating current power source to a direct current voltage step comprises the steps of:

storing energy during a conduction period and delivering energy to the at least two capacitors during a non-conducting period with a plurality of multiplier capacitors;

alternatively charging the plurality of multiplier capacitors to a peak voltage of the alternating current power source with a plurality of multiplier diodes;

delivering energy to the at least two capacitors during the non-conducting period with a plurality of bleeder resistors; and producing a reference voltage with a zener diode.

16. A method for selectively strobing a flashlamp with an electrical circuit as in claim 12 wherein said maintaining the direct current voltage at the predetermined magnitude step comprises the steps of:

producing an error signal by connecting an operational amplifier having a first input, a second input and an output with the voltage rectifier and multiplier wherein the first input is connected to receive a sample voltage from the voltage rectifier and multiplier and the second input is connected to receive a reference voltage;

passing the alternating current power source when the sample voltage is less than the reference voltage and clipping a portion of the alternating current power source when the sample voltage is equal to the reference voltage with a field effect transistor having a drain, a source, and a gate, by connecting the gate to the output of the operational amplifier wherein the field effect transistor conducts current when the output of the operational amplifier is high and the field effect transistor does not conduct current when the output of the operational amplifier is low; and biasing said field effect transistor by connecting a first resistor to the gate of the field effect transistor and by connecting a second resistor to the drain of the field effect transistor.

* * * * *